US006164937A

United States Patent [19]

Lang

[11] Patent Number: 6,164,937

[45] Date of Patent: Dec. 26, 2000

[54] COMPRESSOR PROVIDED WITH AN IMPROVED PISTON

[75] Inventor: Rudolf Lang, Grieselstein, Austria

[73] Assignee: Zanussi Elettromeccanica S.p.A., Pordenone, Italy

[21] Appl. No.: 09/331,371

[22] PCT Filed: May 9, 1998

[86] PCT No.: PCT/EP98/02718

§ 371 Date: Jun. 18, 1999

§ 102(e) Date: Jun. 18, 1999

[87] PCT Pub. No.: WO98/54467

PCT Pub. Date: Dec. 3, 1998

[30] Foreign Application Priority Data

May 26, 1997 [IT] Italy ..... PN970024 U

[51] Int. Cl.[7] ..... F04B 39/10; F04B 53/10

[52] U.S. Cl. ..... 417/569; 417/269

[58] Field of Search ..... 417/553, 438, 417/222.2, 397, 550, 415, 569, 269, 44.2; 92/71

[56] References Cited

U.S. PATENT DOCUMENTS

| | | | |
|---|---|---|---|
| 3,704,079 | 11/1972 | Berlyn | 417/438 |
| 4,867,649 | 9/1989 | Kawashima et al. | 417/222.2 |
| 5,063,829 | 11/1991 | Takao et al. | 92/71 |
| 5,092,744 | 3/1992 | Boers et al. | 417/397 |
| 5,266,015 | 11/1993 | Gannaway | 417/550 |
| 5,346,373 | 9/1994 | Riffe | 417/415 |
| 5,358,383 | 10/1994 | Eisenbacher et al. | 417/569 |
| 5,429,482 | 7/1995 | Takenaka et al. | 417/269 |
| 5,607,287 | 3/1997 | Ikeda et al. | 417/269 |
| 5,655,885 | 8/1997 | Chung | 417/44.2 |
| 5,775,886 | 7/1998 | Terwillinger | 417/553 |
| 6,010,313 | 1/2000 | Kimura et al. | 417/222.2 |

*Primary Examiner*—Teresa Walberg
*Assistant Examiner*—Leonid Fastovsky
*Attorney, Agent, or Firm*—Pearne & Gordon LLP

[57] ABSTRACT

Electric compressor comprising a piston provided with a respective head and a valve plate mounted between the head and the body of the cylinder and provided with a gas suction port, the head being provided with a protrusion adapted to be intermittently introduced in the suction port substantially in the top dead-center position of the piston. The piston is provided externally, in the portion thereof which is opposite to the head side, with a recess that is accessible from the outside and is orientated towards the inner volume of the piston, the recess penetrating the body of the piston down to a depth which is at least equal to the height of the protrusion above the plane of the head.

3 Claims, 3 Drawing Sheets

COMPRESSOR PROVIDED WITH AN IMPROVED PISTON

DESCRIPTION

The present invention refers to a particular embodiment of an alternating-motion piston reciprocating in a respective cylinder.

To more effectively exemplify and more clearly illustrate the invention, said piston is assumed to work in close association with a compressor for refrigerators, in particular household-type appliances, without this however limiting the scope of the invention solely to such an application or connection.

It is a largely known fact that, in view of improving the thermodynamic efficiency of compressors, it is absolutely necessary for the volume of the discharge port, which is not affected by the displacement of the piston, to be as small as possible. The reasons behind such a requirement are well known to those skilled in the art, so that they shall not be dealt with any longer here.

In view of artificially reducing such a volume, the practice is known in the art, for instance from the disclosure in U.S. Pat. No. 5,149,254, of providing, on the head of the related piston, a protrusion (post 54) that is so arranged and sized as to enable said protrusion to almost fully penetrate into the discharge port when the piston reaches its top dead center, without this of course giving rise to any interference with other parts nearby.

This expedient enables the volume of the discharge port that can be occupied by the gas to be temporarily reduced in an artful manner, but to a quite considerable extent, so that the overall compressor efficiency can actually be boosted sensibly, as already mentioned above.

The above solution is certainly simple, reliable, economic and safe; however, in the course of the highly automated production of this kind of pistons a number of practical drawbacks tend to emerge, as described below in greater detail.

The grinding operation on the outer cylinder of said compressor pistons is carried out by means of a grinding technique without a fixed and secured center of rotation; the same process is generally used for producing millions of cylindrical parts such as the cylindrical rollers of roller bearings.

The grinding process essentially consists in a continuous sequence of said pistons carried by conveying means through a plurality of grinding wheels or similar means being abraded by the action of said plurality of grinding wheels or similar means.

The size, orientation and number of said grinding means are such as to enable the pistons conveyed into such a processing step to be sent there in sequence with their axes coinciding with and parallel to the direction of the motion thereof through said plurality of grinding means.

However, if the pistons happen to be arranged in contact with each other, in the sense that the head of one such piston is in contact with the rear edge of the neighbouring piston, then a serious drawback arises in that, owing to the afore mentioned protrusion, said pistons tend to assume a position which is slightly inclined with respect to the direction of motion. The result is that they would come up obliquely in front of or with respect to said grinding means and, therefore, would practically prevent the grinding process from being carried out.

In view of eliminating such a drawback, said pistons are therefore spaced from each other so that the protrusion thereof is prevented from touching any other piston. Such a very simple and effective measure of spacing the pistons from each other, however, has the effect of slowing down and, therefore, decreasing the productivity of the grinding operation, since the pistons must be cadenced into the process at a much lower rate, owing to the need for their forward speed to be maintained unaltered, while the "virtual" length thereof, ie. the length including both the actual length of the piston and the intermediate space that separates it from the subsequent piston in the sequence, is on the contrary increased, as this is best illustrated in the accompanying FIG. 1.

It therefore would be desirable, and is actually a main purpose of the present invention, to provide a technical solution that, when applied to such a compressor piston, does away with the above described drawback in a simple, low-cost and reliable manner. Such an aim shall furthermore be reached through the use of techniques and materials that are simple and readily available on the market, while avoiding to affect the performance capabilities and the overall reliability of the related compressor to any extent.

According to the present invention such aims are reached in a piston of the kind described below by way of non-limiting example with reference to the accompanying drawings, in which FIG. 1 is a symbolic representation of a piston grinding plant according to state-of-art technology;

Figure 1:
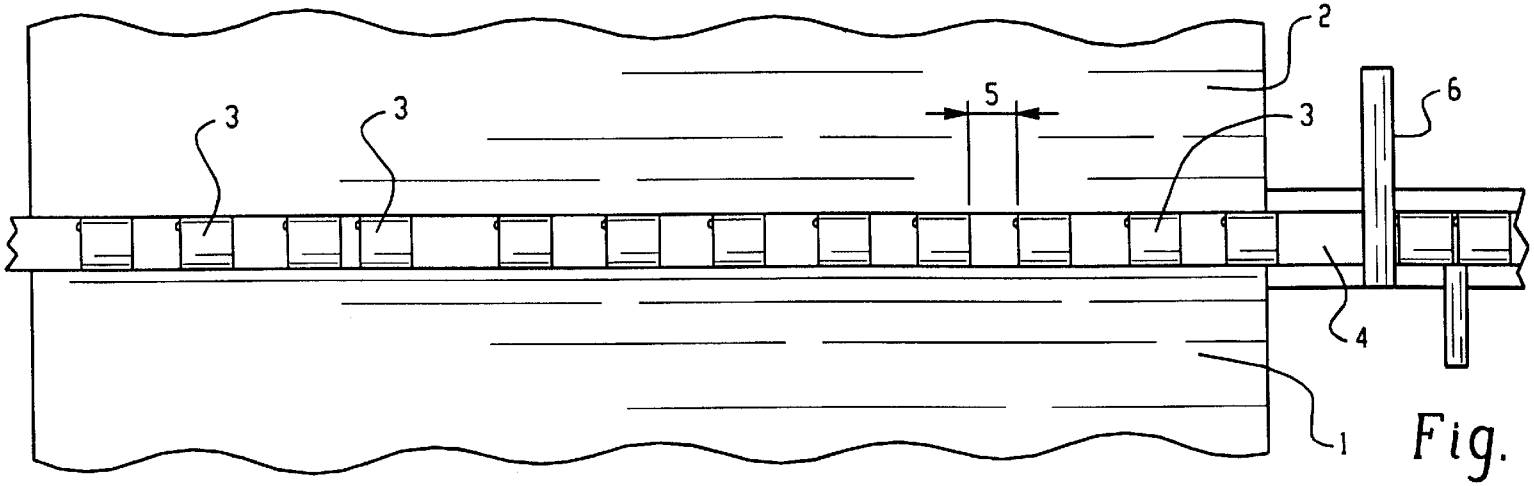

With reference to FIG. 1 the grinding process can be noticed to be carried out presently by making use of at least two wheels, ie. an adjustment wheel 1 and an actual grinding wheel 2. Between said wheels, which rotate on parallel axes, a plurality of pistons 3 are caused to pass in a sequence, preferably carried therethrough on a belt 4 or any other equivalent conveying and support means.

In view of preventing the protrusion of each piston head from interfering with the contiguous piston as mentioned above, each piston is spaced from the next one by a separation interval 5 obtained through proper cadencing and separating means 6 that are largely known in the art.

It can be readily appreciated that, if in this case the forward-moving rate of the pistons is 700 mm/min, the piston length is 23 mm and the distance of each piston from the next one is 25 mm, then the piston output cadence will amount to:

$700/(23+25)\times 60=875$ pistons/hour

Figure 2:
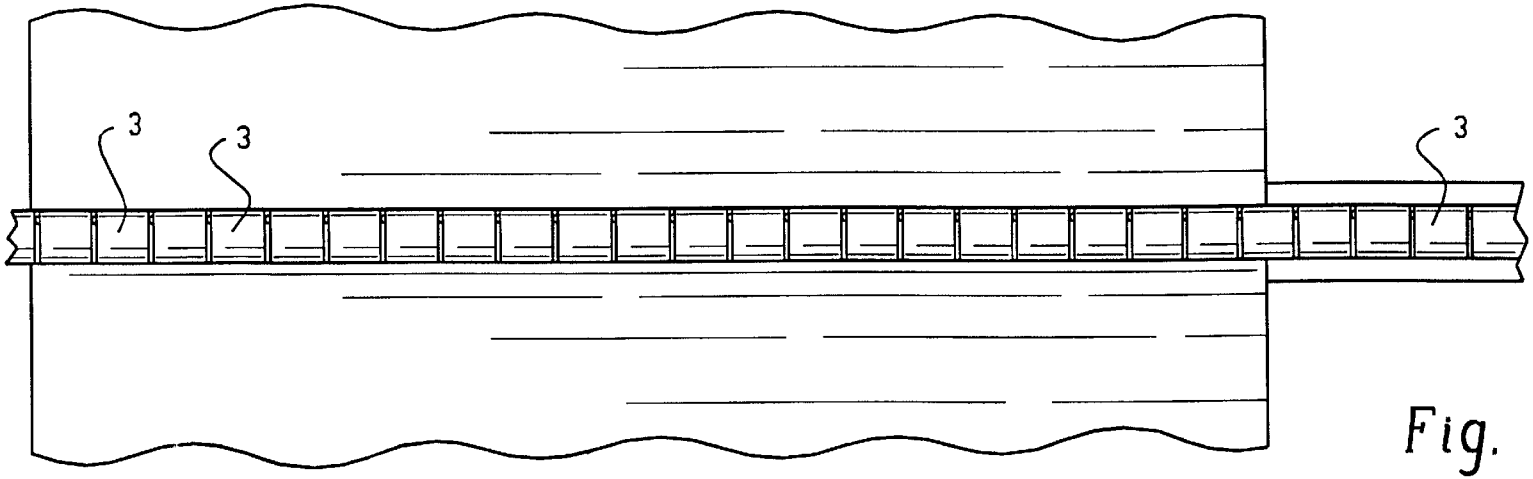
FIG. 2 is a symbolic representation of the same piston grinding plant according to the present invention.
Figure 3:
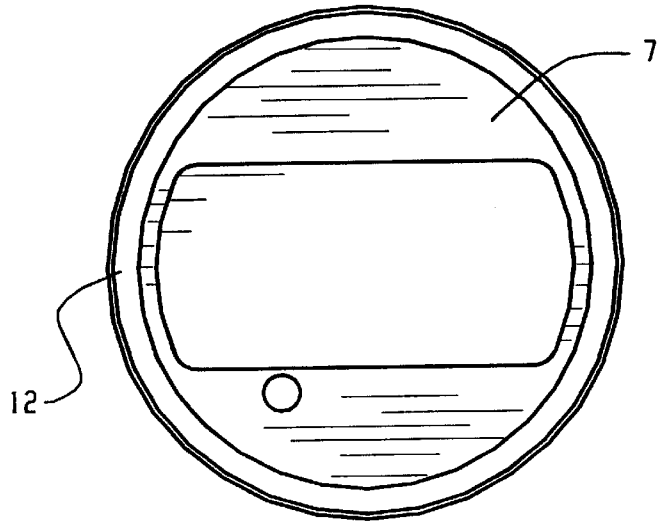
FIG. 3 is a view from the opposite side of the head of a piston according to the present invention.

However, if said pistons could be sent to such a grinding operation without any spacing being provided between them and, therefore, in close contact with each other, as this is symbolically illustrated in FIG. 2, then, all other conditions remaining unaltered, said piston output rate would amount to:

$700/23\times 60=1826$ pistons/hour ie. obtaining in this way an hourly output that is far more than the double value of the one achievable with prior-art technology.

Figure 4:
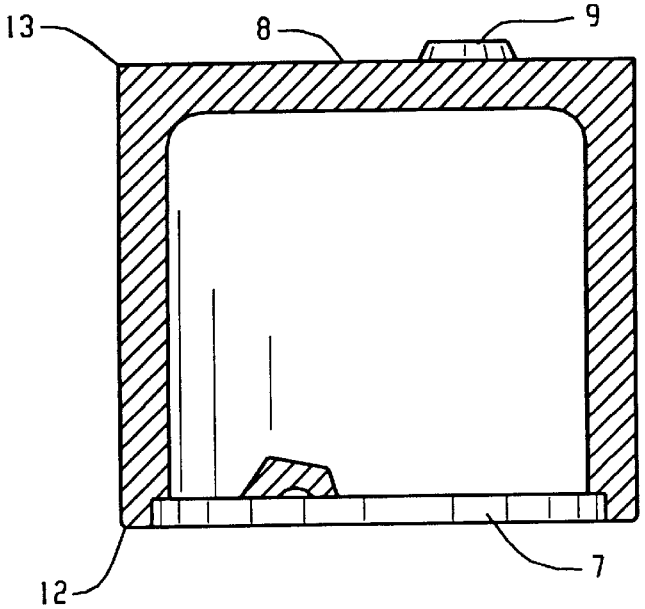
FIG. 4 is a longitudinal-section view of the same piston shown in FIG. 3.
Figure 5:
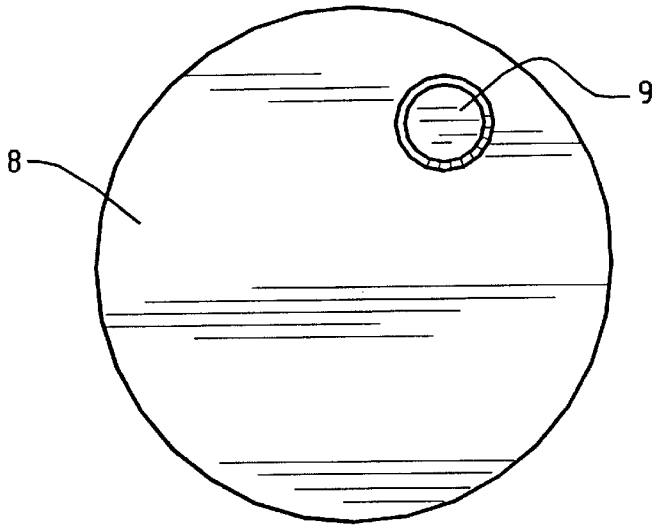
FIG. 5 is a view from the head of the same piston.

According to the invention, the possibility of feeding the pistons to grinding with the head of each piston in close contact with the bottom of the contiguous piston, wherein each such piston head is provided with the afore described protrusion, is obtained by providing each piston with a substantially cylindrical recess 7 provided on the side of the piston which is opposed to the head 8 thereof, as this is best illustrated in FIG. 4, so as to make it possible, by arranging the pistons against each other and oriented in the same direction, for the protrusion on the head of a piston to freely enter, without any constraint and in any angular position of the same pistons, in said recess of the contiguous piston, thereby obtaining that said protuberances do not interfere with the contiguous pistons, which therefore can maintain the same axis and, at the same time, remain in close contact with each other.

Figure 6:
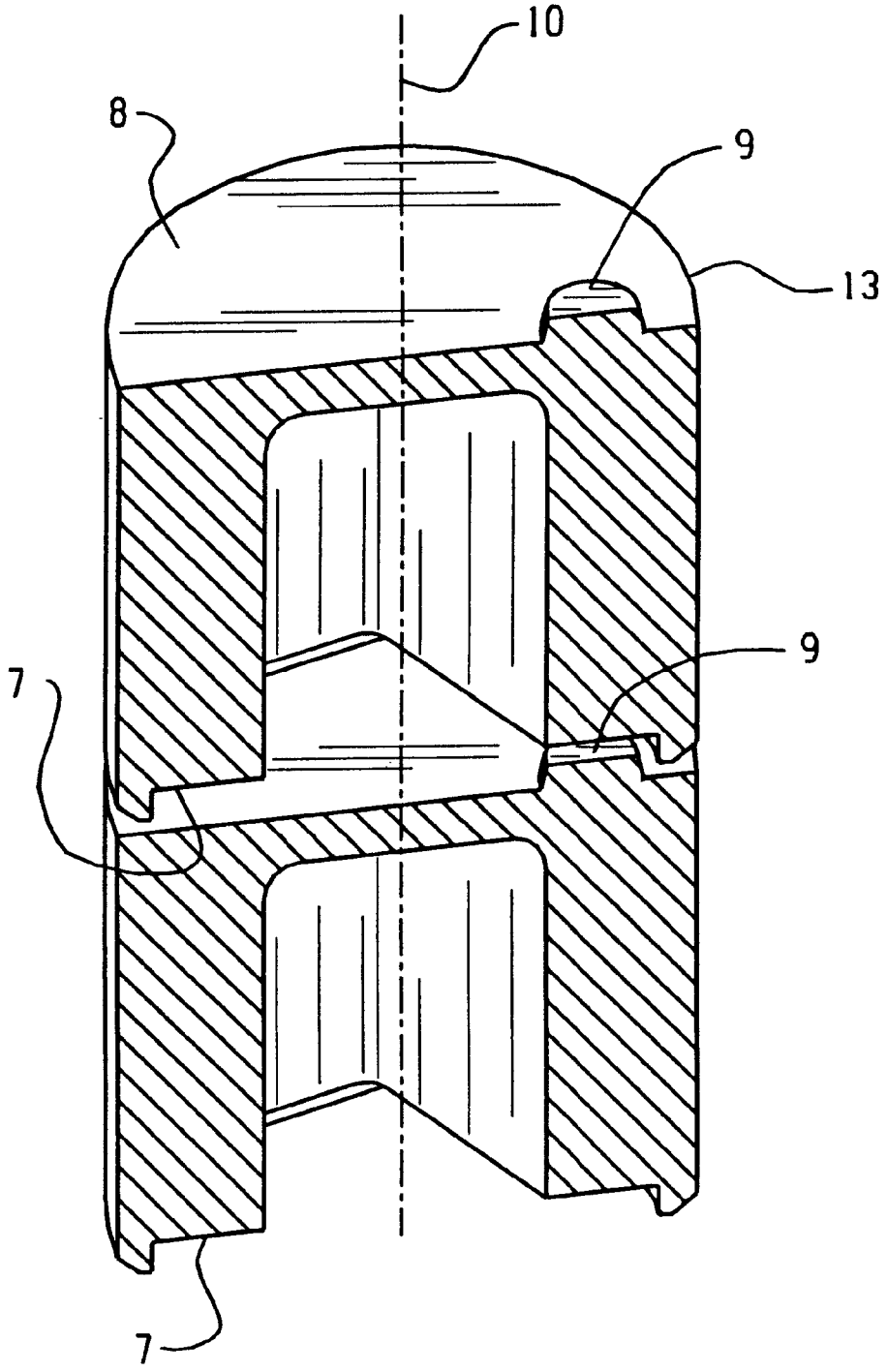
FIG. 6 is a sectional view of two pistons according to the present invention, in which the head of one of them is in contact with the bottom portion of the other one.

To such a purpose, said recess must have following features: it shall first of all extend inside the body of the piston for a depth that is at least equal to the height of the protrusion 9 from the level of the head 8; furthermore, said recess shall be capable of accomodating the protrusion of the contiguous piston, such as this is illustrated in FIG. 6, regardless of the position in which the pistons may find themselves in relation with each other in the direction of rotation with respect to the common axis 10. This practically not only enables the pistons to be delivered to the grinding line regardless of the actual angular position or orientation thereof, but also makes it possible for each piston fully free to rotate during grinding and transport, independently of the two pistons that precede and follow it.

Such a link-up can be obtained with a recess 7 that provides, toward the outer cylindrical surface of the piston, a circular edge 12 having no larger thickness than the minimum distance between said protrusion 9 projecting from the head of the piston and the circular edge 13 of the same head.

Given such constraints, it can be readily appreciated that such a recess will preferably have a cylindrical shape. However, such a recess may also be given any other appropriate shape, provided that it enables the basic requirement placed on the same recess to be met, ie. the capability thereof to fully accomodate said protrusion thereinto.

In such a case, said recess comes to be situated in front of a cavity 20 provided within the body 21 of the piston and adapted to accomodate said gudgeon pin 22 made integrally with the head 23 of the respective connecting rod 24.

What is claimed is:

1. Electric compressor, comprising a cylinder body, a piston provided with a respective head (8), a valve plate arranged between said head and the body of said cylinder and provided with a gas suction port, said head being provided with an excentric protrusion (9) capable of being intermittently inserted in said port, said piston being provided, in the portion thereof which is opposed to the head side, with a recess (7) that is accessible from the outside and is oriented towards the inner volume of said piston, characterized in that said recess extends into the body of said piston down to a depth that is at least equal to the height of said protrusion (9) above the plane of said head.

2. Electric compressor according to claim 1, characterized in that said recess has a substantially cylindrical shape having its axis (10) coinciding with the axis of the piston, said recess being further delimited externally by a circular edge (12) that constitutes the terminal portion of the cylindrical surface of the piston opposed to said head, the thickness of said circular edge being not greater than the minimum distance between said protrusion (9) projecting from the head and the circular edge (13) of the same head.

3. Electric compressor according to any of the preceding claims, characterized in that said recess (7) is made integrally with said piston.

* * * * *

UNITED STATES PATENT AND TRADEMARK OFFICE

CERTIFICATE OF CORRECTION

PATENT NO. : 6,164,937
DATED : December 26, 2000
INVENTOR(S) : Lang

It is certified that error appears in the above-identified patent and that said Letters Patent is hereby corrected as shown below:

Title Page, Section [30],
Foreign Application Priority Data, delete "PN90024U"
and insert --PN97U000024--.

Signed and Sealed this

Tenth Day of July, 2001

*Attest:*

Nicholas P. Godici

*Attesting Officer*

NICHOLAS P. GODICI
*Acting Director of the United States Patent and Trademark Office*